United States Patent [19]

Takegawa

[11] Patent Number: 4,808,030

[45] Date of Patent: Feb. 28, 1989

[54] SHIELD TUNNELING METHOD AND ASSEMBLING AND DISASSEMBLING APPARATUS FOR USE IN PRACTICING THE METHOD

[75] Inventor: Keinosuke Takegawa, Tokyo, Japan

[73] Assignee: Shimizu Construction Co., Ltd., Tokyo, Japan

[21] Appl. No.: 944,339

[22] Filed: Dec. 18, 1986

[30] Foreign Application Priority Data

Dec. 25, 1985 [JP] Japan ..... 60-295378
Dec. 26, 1985 [JP] Japan ..... 60-295748

[51] Int. Cl.[4] ..... E21D 9/06; E21D 11/10

[52] U.S. Cl. ..... 405/146; 405/142; 405/145; 405/151; 264/33; 425/63

[58] Field of Search ..... 405/138, 141, 142, 145, 405/146, 151, 152, 150; 425/63, 64; 249/11; 264/31, 33

[56] References Cited

U.S. PATENT DOCUMENTS

| | | | |
|---|---|---|---|
| 3,678,694 | 7/1972 | Haspert | 405/146 |
| 3,859,810 | 1/1975 | Winberg et al. | 405/151 X |
| 4,072,021 | 2/1978 | Yamazaki | 405/146 |
| 4,621,948 | 11/1986 | Hentschel | 405/146 |
| 4,627,765 | 12/1986 | Hentschel | 405/146 |
| 4,645,378 | 2/1987 | Hentschel | 405/146 |

FOREIGN PATENT DOCUMENTS

| | | | |
|---|---|---|---|
| 2802575 | 7/1979 | Fed. Rep. of Germany | 405/146 |

*Primary Examiner*—Randolph A. Reese
*Assistant Examiner*—John A. Ricci
*Attorney, Agent, or Firm*—Hoffmann & Baron

[57] ABSTRACT

Shield tunnelling method and assembling and disassembling apparatus for use in practicing the method. A shield having shield jacks is actuated for drilling a hole in the ground. Inner forms and outer forms are assembled into a plurality of tubular units coaxially jointed in the hole so that an annular concrete lining space is defined between the inner forms and the outer forms, the tubular units having a leading tubular unit.

The shield jacks are applied against inner forms of the leading tubular units for thrusting the shield during actuating of the shield to further drill the hole. A concrete is injected into the annular concrete lining space to form a concrete lining. The concrete lining within a predetermined length of tubular units is set for providing adhesion to the inner forms, in contact with the concrete lining, against a reaction force of the jack thrust for the shield. Inner forms of the tubular units, located behind the predetermined length of the tubular units, are disassembled from the associated outer forms so that the predetermined length of the concrete lining is remained covered with inner forms. The inner forms disassembled are reused in the assembling of inner forms and outer forms for assembling a new tubular unit in the hole just behind the shield.

10 Claims, 8 Drawing Sheets

SHIELD TUNNELING METHOD AND ASSEMBLING AND DISASSEMBLING APPARATUS FOR USE IN PRACTICING THE METHOD

BACKGROUND OF THE INVENTION

The present invention relates to a shield tunneling method and further relates to an apparatus for assembling and disassembling form assemblies for forming a concrete lining in practicing the method.

In a typical example of conventional shield tunneling method, a steel cylindrical tube called shield is thrusted into the ground from a starting shaft to drill a hole by its front portion. A tunnel is constructed by lining the wall of a hole behind the shield during the further drilling of the hole.

The lining consists of a primary lining, using form segments, and a secondary lining made of a concrete. The primary lining is carried out by assembling arcuate segments with an erector into a ring-shaped form so that the latter is arranged circumferentially on the wall of the hole. The segments must bear long-time loading due to earth pressure and ground-water pressure and further sustain a large shield jack thrust for the shield. After the assembling of the segments, steel forms are assembled inside the segments so that a concrete lining space is defined between the segments and the steel forms. Then, a concrete is placed into the space to form the secondary lining. This concrete lining provides waterproofing and appearance finish. The steel forms are manually disassembled after setting of the concrete.

The prior art shield tunneling method is disadvantageous in the following points:

(1) The segments are costly since they must have a permanent lining structure which sustains the long-time loads in addition to the shield jack thrust and since they are buried in the concrete lining are not reused;

(2) The secondary concrete lining, which is needed for both waterproofing and finishing of the tunnel, uses a considerable part of the construction period of the tunnel and raises the construction cost; and (3) The assembling and disassembling of steel forms, which are needed for the concrete lining, make the construction work rather laborious, thus preventing the construction period from being shortened.

SUMMARY OF THE INVENTION

Accordingly, it is an object of the present invention to provide a shield tunneling method in which a tunnel is constructed without using expensive segments and without the secondary lining, thus achieving considerable reduction in both construction period and cost.

With this and other objects in view, the present invention provides a shield tunneling method in which: a shield having shield jacks is actuated for drilling a hole in the ground; inner forms and outer forms are assembled into a plurality of tubular units concentrically jointed in the hole so that an annular concrete lining space is defined between the inner forms and the outer forms, the tubular units having a leading tubular unit; the shield jacks are applied against inner forms of the leading tubular units for thrusting the shield during actuating of the shield to further drill the hole; a concrete is injected into the annular concrete lining space to form a concrete lining; the concrete lining within a predetermined length of tubular units is set for providing adhesion to the inner forms, in contact with the concrete lining, against a reaction force of the jack thrust for the shield; inner forms of the tubular units, located behind the predetermined length of the tubular units, are disassembled from the associated outer forms so that the predetermined length of the concrete lining is remained covered with inner forms; and the inner forms disassembled are reused in assembling and disassembling of inner and outer forms for a new tubular unit in the hole just behind the shield.

Another aspect of the present invention is directed to an assembling and disassembling apparatus for use in practicing the method. The apparatus includes: (a) guiding means mounted to the inner forms of the tubular units; (b) an assembling erector for assembling inner forms and outer forms, circumferentially in the hole, into a tubular unit just behind the shield; and (c) a disassembling erector for disassembling the inner forms of the tubular units, located behind the predetermined length of the tubular units. The assembling erector includes: first supporting means; first holding means for releasably holding the first supporting means to the inner forms of the tubular units; first moving means, mounted to the first supporting means, for moving the first supporting means with the guiding means; and transporting means, supported on the first supporting means, for transporting each of inner forms and outer forms to position on a wall of the hole. The disassembling erector includes: second supporting means; second holding means for releasably holding the second supporting means to the inner forms of the tubular units; second moving means, mounted to the second supporting means, for moving the second supporting means with the guiding means; and separating means, supported on the second supporting means, for separating the inner forms of the tubular units, located behind the predetermined length of the tubular units, from the associated outer forms.

With such a construction, the apparatus achieves the assembling and disassembling of tubular units in a highly efficient and safe manner.

The first holding means may include a plurality of first jacks, mounted to the first supporting means, for releasably holding the first supporting means to inner forms of the tubular units, and the second holding means comprises a plurality of second jacks, mounted to the second supporting means, for releasably holding the second supporting means to inner forms of the tubular units.

The assembling and disassembling erectors having such a construction may be used in construction for other tunnels having different diameters by adjusting the strokes of the jacks.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
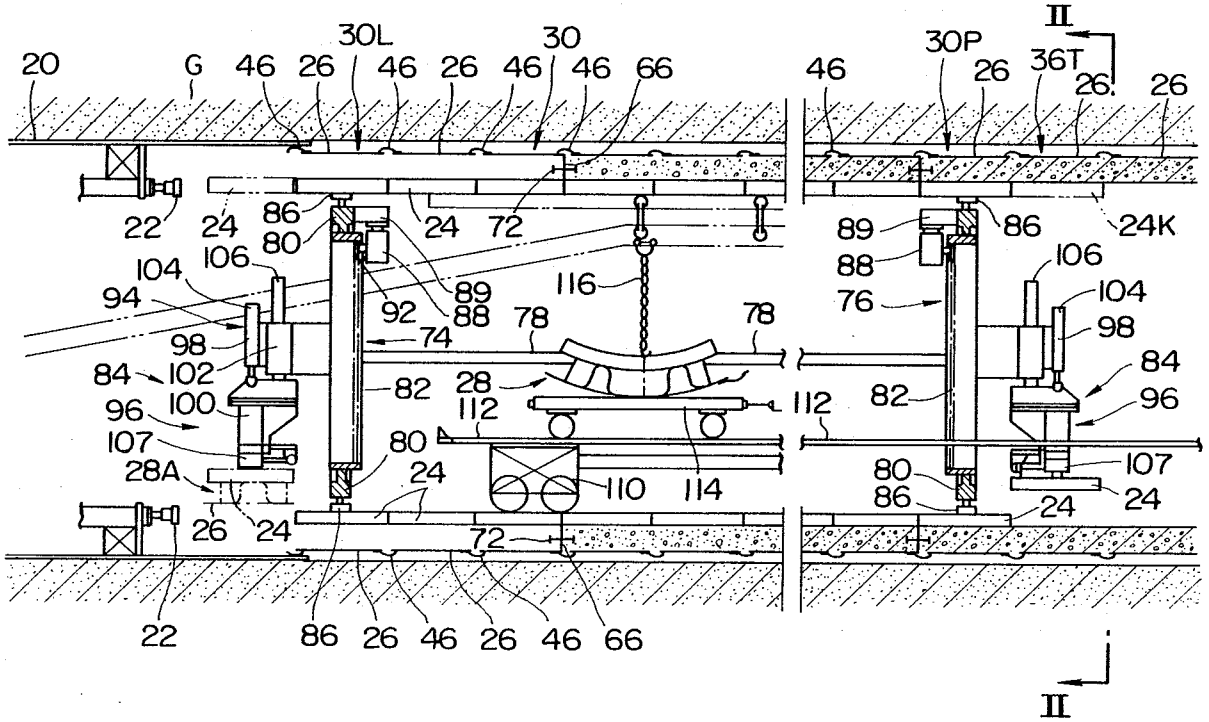
FIG. 1 is a vertical axial section of a tunnel which is being constructed according to the present invention.

Referring now to the drawings, like reference characters designate corresponding parts throughout views and descriptions thereof are omitted after once given. In FIG. 1, the reference numeral 20 designates a conventional shield with which a tunnel is constructed in ground G. Only part of the shield 20 is illustrated in FIG. 1. The shield 20 has jacks 22 for thrusting it. Reference numerals 24 and 26 indicate inner forms and outer forms, respectively. Corresponding inner forms 24 and outer forms 26 are assembled to form arcuate form assemblies 28 as clearly illustrated in FIG. 3. Six arcuate form assemblies 28 are assembled into a hollow cylindrical unit 30 as a tubular unit.

Figure 4:
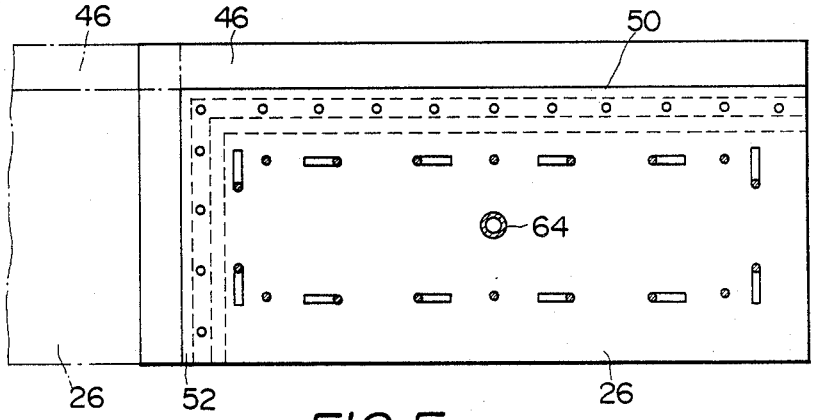
FIG. 4 is a view taken along the line VI—VI in FIG. 3.

Each outer form 26 includes a slightly arcuate body plate 32, rectangular in plan view, retaining bolts 34 jointed at their proximal ends to the inner face 36 of the body plate 32 for connecting the body plate 32 to a corresponding inner form 24 with nuts 38. Each outer form 26 further has spacer rods 40, welded at their one ends to the inner face 36 of the body plate 32, and generally U-shaped spacers 42 welded at their legs 44 to that inner face 36. The spacer rods 40, U-shaped spacers 42 and the bolts 34 serve to retain the thickness of a concrete lining space S defined with the inner and outer forms 24 and 26 and to transmit earth pressure and ground-water pressure, applied to the outer forms 26, to the inner forms 24. An L-shaped waterproof rubber plate 46 is bolted to the outer face 48 of each outer form 26 so that it projects from both one lateral edge 50 and one transverse edge 52 thereof as illustrated in FIG. 4.

Each inner form 24 has an arcuate body plate 54 rectangular in plan view and curved in the longitudinal direction. The arcuate body plate 54 has a pair of parallel arcuate lateral flanges 56 and 56, perpendicularly jointed to respective lateral peripheries thereof, and a pair of parallel end flanges 58 and 58 perpendicularly jointed to respective end peripheries and integrally formed with both the lateral flanges 56. The lateral flanges 56 are used for jointing inner forms 24, disposed adjacent in the axial direction of the tunnel, together and the end flanges 58 are for inner forms 24, disposed adjacent in the circumferential direction of the tunnel, together. Each inner form 24 further has transverse ribs 60, connecting the body plate 54 and the lateral flanges 56 together, and a bracket 62 jointed to the body plate 54 for hooking it. The body plate 54 is provided with a through hole 61 and with an injection pipe 63 jointed to it for communication with the through hole 61 to inject concrete or backfill grout. A communication pipe 64 is jointed to the body plate 32 of each outer form 26 of every another hollow cylindrical unit 30 so that its proximal end passes through that body plate. When inner forms 24 and outer forms 26 are assembled together, each communication pipe 64 is registered to the injection pipe 62 of a corresponding inner form 24 for injecting backfill grout.

Figure 6:
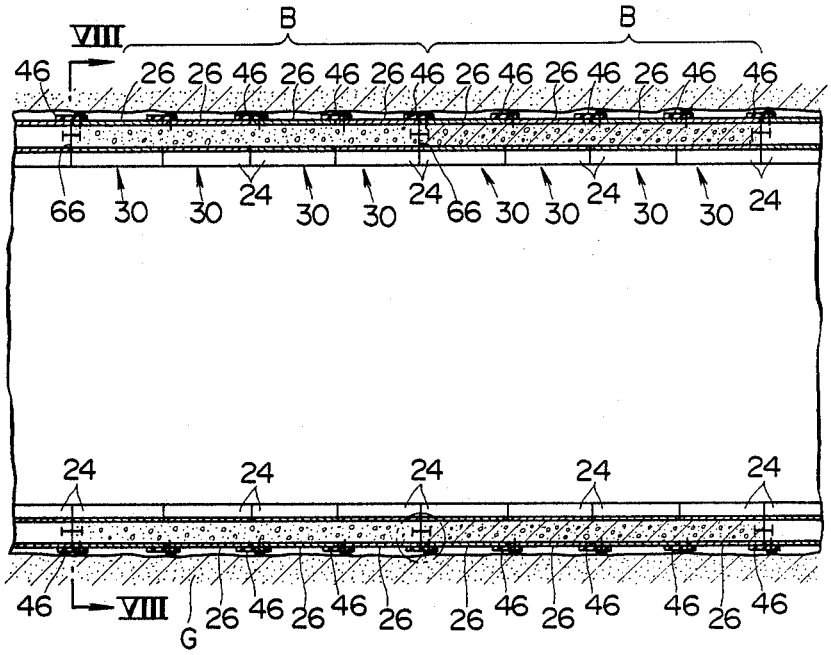
FIG. 6 is an enlarged axial cross-section of the tunnel in FIG. 1.
Figure 7:
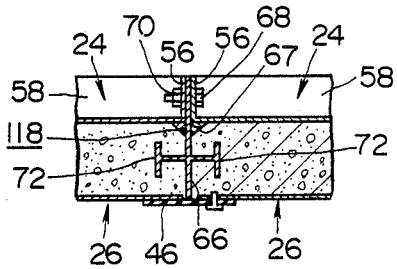
FIG. 7 is an enlarged view of the portion circled in FIG. 6.
Figure 8:
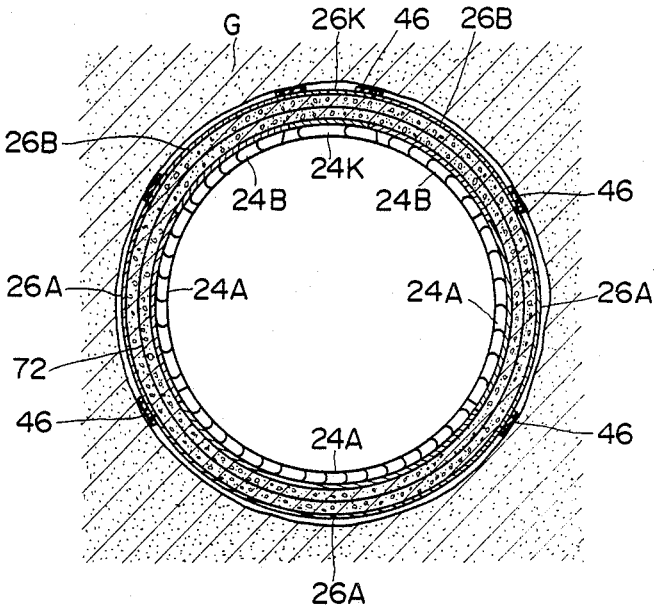
FIG. 8 is a view taken along the line VIII—VIII in FIG. 6.
Figure 9:
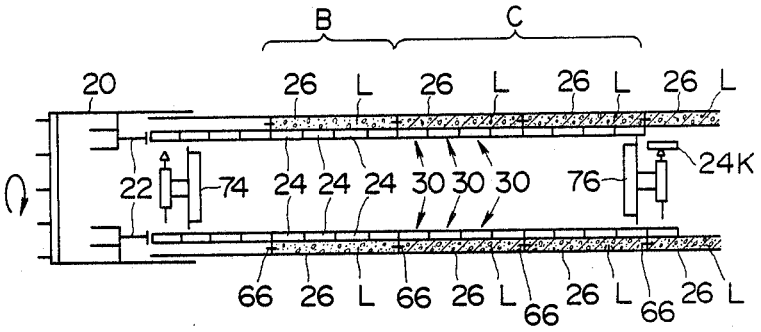
FIGS. 9 to 12 are diagrammatic axial cross-sections, with a modified scale, of the tunnel in FIG. 1, wherein various construction steps are illustrated.

FIGS. 6 and 7 illustrate a connection structure of axially adjacent inner and outer forms 24 and 26. One lateral periphery of each outer form 26 is placed on rubber plate 46 of an axially adjacent outer form 26. An end ring 66 is interposed between axially adjacent arcuate form assemblies 28 in every four hollow cylindrical units 30 so that it closes one end of the concrete lining space S. The inner periphery of each end ring 66 is sandwiched between lateral flanges 56 of axially adjacent inner forms 24 and jointed with bolts 68 and nuts 70 to the lateral flanges 56. The end rings 66 are each placed at their outer peripheries in contact with the rubber plate 46. Thus, end rings 66 separate annular concrete lining spaces S in every four hollow cylindrical units 30, each annular concrete lining space S being defined within hollow cylindrical units 30 coaxially arranged. Each end ring 66 is provided to its each face with a water proof ring member 72 having a T section.

Figure 2:
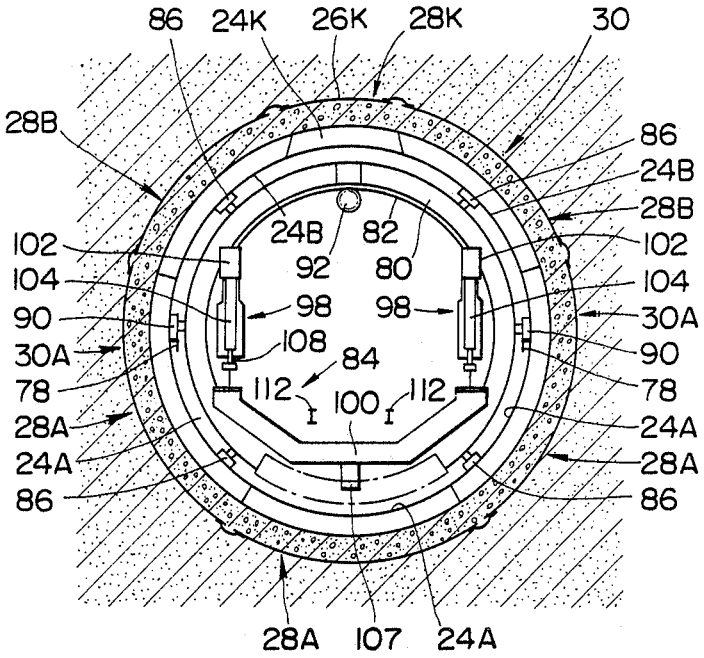
FIG. 2 is a view taken along the line II—II in FIG. 1.

In this embodiment, each hollow cylindrical unit 30, as shown in FIG. 2, includes six arcuate form assemblies 28A, 28A, 28A, 28B, 28B and 28K and is assembled by disposing three A-type arcuate form assemblies 28A, 28A and 28A to form its bottom and opposite lateral sides 30A and by disposing two B-type arcuate form assemblies 28B and 28B and one K-type arcuate form assembly 28K to define its ceiling portion. As shown in FIG. 1, a predetermined number of hollow cylindrical units 30 are coaxially arranged in the tunnel in a manner hereinafter described.

Disposed in a leading hollow cylindrical unit 30L is an assembling device 74 for assembling six arcuate form assemblies 28A, 28B and 28K into another hollow cylindrical unit 30 and placed in a penultimate hollow cylindrical unit 30P is a disassembling device 76 for disassembling the trailing hollow cylindrical unit 30T. For guiding both the assembling and disassembling devices in the drilling direction, a pair of guide rails 78 and 78 are mounted to inner forms 24 and 24 of respective lateral sides 30A and 30A of the hollow cylindrical units 30.

The assembling device 74 includes a ring-shaped supporting member 80, an inner gear member 82 coaxially fitted into the supporting member 80 and rotatably supported by the latter, and a well-known gripping and transporting device 84 mounted to the inner gear member 82. The outer diameter of the supporting member 80 is slightly smaller than the inner diameter of the hollow cylindrical units 30. The supporting member 80 has several, four in this embodiment, supporting jacks 86 mounted to it for releasably holding it to inner faces of the hollow cylindrical unit 30, each supporting jack 86 having a rod extendable in a radial direction of the supporting member 80. Further, the supporting member 80 has a drive unit 88, mounted with a mounting 89 to it for rotating the inner gear member 82 about its axis, and rollers 90 and 90 rotatably mounted to it at symmetrical side positions, the rollers being engaged with the guide rails 78 and 78 for moving it in the drilling direction. The drive unit 88 includes an electric motor (not shown) and a pinion 92 mounted on its output shaft to engage with the inner gear member 82. The gripping and transporting device 84 has a jack section 94 and a gripping section 96. The jack section 94 includes a pair of jacking units 98, mounted to the inner gear member 82. Each jacking unit 98 has a mounting 102, mounted to the inner gear member 82, and a jack 104 mounted to the mounting 102. The gripping section 96 includes a generally bow-shaped connecting member 100, connected to the jacking units 98 for vertical movement, and a conventional form gripping device 107 mounted to the center of the connecting member 100. Each end of the connecting member 100 has a slide rod member 106 which is vertically jointed to it and slidably passes through a corresponding mounting 102. The rod 108 of each jack 104 is jointed to the associated end of the connecting member 100. The disassembling device 76 has the same structure as the assembling device 74 and description thereof is omitted.

A pair of supporting vehicles 110, only one of which is illustrated in FIG. 1, are placed within the hollow cylindrical units 30 and a pair of parallel rails 112 and 112 are mounted on the supporting vehicles 110 and 110 to pass through the inner gear 82 of the disassembling device 76. Placed on the rails 112 and 112 is a truck 114 for carrying components of hollow cylindrical units 30. An electric chain block 116 for both transporting arcuate form assemblies 28 and removed inner forms 24 is suspended from the ceiling of hollow cylindrical units 30.

Figure 3:
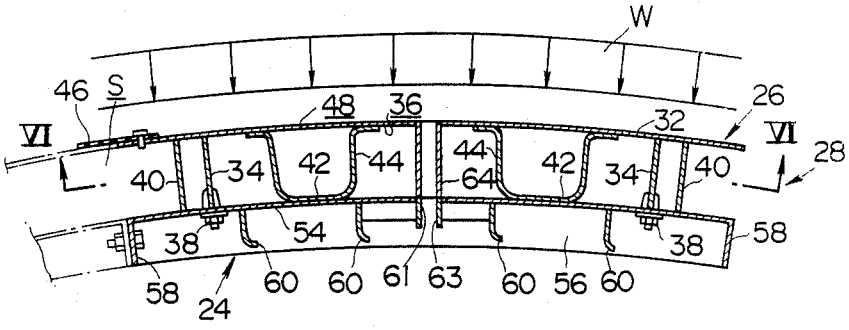
FIG. 3 is an enlarged cross-section of part of the hollow cylindrical unit in FIG. 1.

FIGS. 9 to 12 demonstrate how to construct the tunnel according to the present invention simultaneously with the assembling and disassembling of hollow cylindrical units 30. In this embodiment, the inner diameter of the tunnel is about 3 to 4 m, axial length of the hollow cylindrical unit 30 is about 1 m and the concrete lining L is about 30 cm thick. The tunnel is constructed as follows:

(i) Arcuate form assemblies 28A, 28B and 28K are each built by putting an inner form 24 and an outer form 26 together with a waterproof rubber plate 46 fastened to its outside as shown in FIG. 3.

(ii) Then, the arcuate form assemblies 28 are transported to the assembling device 74, by means of which they are assembled into a hollow cylindrical unit 30 as described below. In constructing a new hollow cylindrical unit 30, the assembling device 74 is held to inner forms of a previously assembled leading hollow cylindrical unit 30 by stretching four supporting jacks 86. Next, a new bottom arcuate form assembly 28A is connected to the form gripping device 107 of the gripping section 96 of the gripping and transporting device 84 by means of a pin or bolt which passes through the hole of the bracket 62 of the inner form 24. Then, the inner gear member 82 is rotated by actuating the drive unit 88 to place the connected new arcuate assembly 28A at a position shown by the dot-and-dash line in FIGS. 1 and 2. After this, the jacks 104 and 104 are actuated to locate the new arcuate form assembly 28A on the bottom portion of the tunnel or at the bottom portion of a new hollow cylindrical unit 30 to be assembled. The new arcuate form 28A thus located at the bottom is fastened to the bottom arcuate form 28A of the leading hollow cylindrical unit 30 with the trailing lateral flange 56 of the former jointed to the leading lateral flange 56 of the inner form 24 of the latter with bolts and nuts as shown in FIG. 7 although in this case the end ring 66 is not used. Then, a pair of lateral arcuate form assemblies 28A and 28A are prepared. Each of the lateral arcuate form assemblies 28A and 28A has a guide rail 78 suitably jointed to the inner face of the body plate 54 of the inner form 24, but the guide rails 78 may be jointed to the lateral arcuate form assemblies 28A and 28A after the latter are assembled. The lateral arcuate form assemblies 28A and 28A are similarly placed at the opposite lateral portions of the new hollow cylindrical unit 30 to bring their end flanges 58 into abutment with corresponding end flanges 58 of the arcuate form assembly 28A placed in the bottom as illustrated in FIG. 2, after which the abutting end flanges 58 are fastened together with bolts and nut as illustrated in FIG. 3 and the lateral flanges 56 are similarly fastened to corresponding lateral flanges 56 of the inner forms 24 of lateral arcuate assemblies 28A and 28A of the leading hollow cylindrical unit 30. Similarly, a pair of arcuate form assemblies 28B and 28B are, as illustrated in FIG. 2, disposed above corresponding lateral arcuate form assemblies 28A and 28A already assembled with their end flanges 58 fastened to corresponding end flanges 58 of the lateral arcuate assemblies 28A and 28A and then an arcuate form assembly 28K is arranged to the top portion of the new hollow cylindrical unit 30 with its end flanges 58 fastened to corresponding end flanges 58 of the arcuate form assemblies 28B and 28B thus assembled. The arcuate form assemblies 28B, 28B and 28K of the new hollow cylindrical unit 30 are also fastened to the arcuate form assemblies 28B, 28B and 28K of the leading hollow cylindrical unit 30 respectively in the same manner as the three arcuate form assemblies 28A.

(iii) Then, the shield 20 is thrusted a predetermined distance, larger than an axial length of one hollow cylindrical unit 30, forwards by actuating the jacks 22 to push inner forms 24 of the new leading hollow cylindrical unit 30.

(iv) After the new leading hollow cylindrical unit 30 is assembled, the assembling device 74 is released from the previously leading hollow cylindrical unit 30 by retracting the jacks 86 and is suspended from the guide rails 78 and 78 through the rollers 90 and 90. The assembling device 74 is then moved forwards to the new leading hollow cylindrical unit 30 manually or by means of a winch and is similarly held there by restretching the jacks 22 against the inner forms 24.

(v) By repeating the steps (i) to (iv), several hollow cylindrical units 30, four units in this embodiment, are coaxially assembled and jointed by fastening adjacent inner forms 24 together with bolts and nuts as illustrated hereinbefore.

(vi) Then, an end ring 66 is fastened to leading lateral flanges 56 of the inner forms 24 of the new leading hollow cylindrical unit 30 with bolts 68 and nuts 70 in a similar manner as shown in FIG. 7, so that a closed hollow cylindrical concrete lining space S (FIG. 10) is defined by the four inner forms 24, the four outer forms 26, and the two end rings 66 and 66. Before securing the end ring 66, a corner ring member 67 having a right-angled triangular cross-section is bonded to the front periphery of the inner face of the leading one of the four inner forms 24 for forming a V-shaped annular groove 118. Thus, a concrete placement section A is constructed. The trailing one of the four inner forms 24 has also another end ring 66 and corner ring member 67 already mounted to it.

In the concrete placement section A, loads due to both earth pressure and groundwater pressure applied to outer forms 26 are transmitted to the jointed inner forms 24 through bolts 34, spacer rods 40 and U-shaped spacers 42 and the inner forms 24 sustain the loads.

Figure 10:
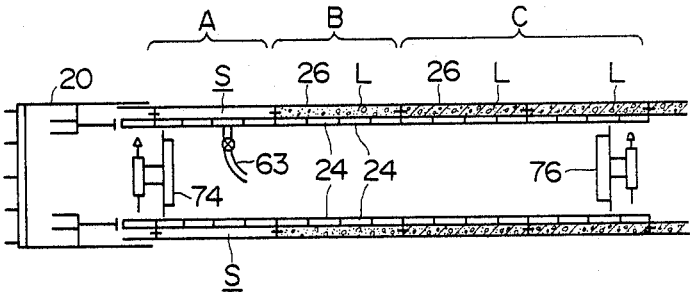
Figure 11:
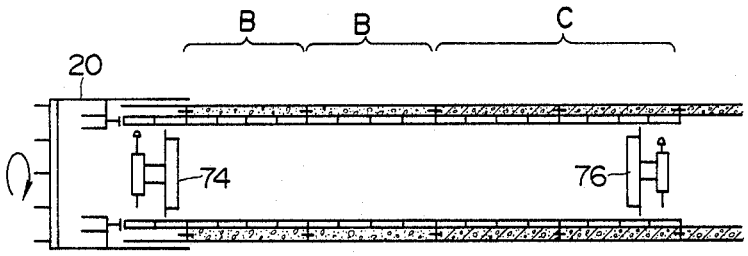

(vii) Then, the steps (i) to (iv) are repeated to assemble another hollow cylindrical unit 30 in front of the concrete placement section A as shown in FIGS. 6, 7 and 10. Thereafter, concrete is placed by means of a conventional concrete placing machine into the concrete lining space S through injection pipes 63 to form a concrete lining L and backfill grout is injected into the space, defined between the outer forms 26 of the four hollow cylindrical units 30 and the wall of the tunnel, through an injection pipe 61 and a communication pipe 64 communicated to the injection pipe 61. Thus, an unset concrete section B in which the concrete is not yet set is formed. The outer forms 26 of the section B are embedded in the concrete as a lining material together with the end rings 66. The T-shaped waterproof members 72 serve to transfer loads in concrete joints as well as enhance waterproof effect.

Figure 12:
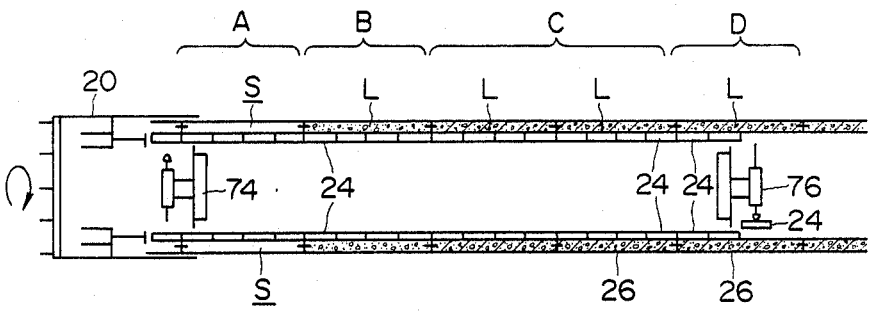

(viii) The other portion of wall of the hole is further covered with a concrete lining by repeating the steps (i) to (vii). With such a manner, the concrete injection section A is, as illustrated in FIG. 12, followed by an unset concrete section B, which is in turn followed by a set concrete portion. The set concrete portion includes a thrust sustaining section C and an inner forms disassembling section D. The thrust sustaining section C consists of a predetermined number of hollow cylindrical units 30, in this embodiment eight hollow cylindrical units 30. In the thrust sustaining section C, the concrete lining L bears long-time loads from the ground G and further sustains jack thrust due to frictional force or adhesion to inner forms 24, the jack thrust being applied to the inner forms 24 during progressing of the shield 20. Thus, the thrust sustaining section C has an axial length sufficient to provide an adhesion force to the associated inner forms 24 against the jack thrust.

(ix) When the concrete portion exceeds a predetermined length, in this embodiment about 8 m, i.e., an axial length of eight hollow cylindrical units 30, inner forms 24 of the inner forms disassembling section D are, as illustrated in FIG. 12, removed by means of the disassembling device 76 from its tail portion with inner forms 24 of the thrust sustaining section C being left.

For disassembling inner forms 24, the disassembling device 76 is moved to a hollow cylindrical unit 30 located immediately in front of a trailing hollow cylindrical unit 30 of which the inner forms are to be disassembled and then the supporting jacks 86 thereof are stretched to hold it against inner forms 24 of the hollow cylindrical unit 30 in which it is placed. Subsequently, the inner gear member 82 is rotated by actuating the drive unit 88 for moving the gripping and transporting device 84 to position for removing the top inner form 24K (FIG. 2) of the top arcuate form assembly 28K of the hollow cylindrical unit 30 to be disassembled. Then, the jacks 104 of the gripping and transporting device 84 are stretched so that the form gripping device 107 of the gripping section 96 may grips the top inner form 24K by passing a pin or a bolt through the hole of the bracket 62. After jointing of the inner form 24K to the form gripping device 107, it is released from both the associated top outer form 26K and adjacent inner forms 24 by disengaging nuts from bolts 34, 68, etc. Then, the top inner form 24K is removed by retracting the jacks 104. The other inner forms 24A and 24B of the hollow cylindrical unit 30 are similarly removed.

The inner forms 24 disassembled and new outer forms 26 are assembled into new arcuate form assemblies 28A, 28B and 28K for constructing a new hollow cylindrical unit 30. As shown in FIG. 1, the new arcuate form assembly 28 is carried forwards by means of the truck 114 to the vicinity of the assembling device 74 and then suspended from the electric chain block 116, which transports the new arcuate form assemblies 28 to the gripping section 96 of the assembling device 74.

Lastly, in the inner forms disassembling section D, the end ring 66 is cut at its inner edge which projects from the V-shaped ring groove 118 (FIG. 6) and then the V-shaped ring groove is filled with a conventional caulking compound. Thus, a portion of the tunnel is completed.

Figure 5:
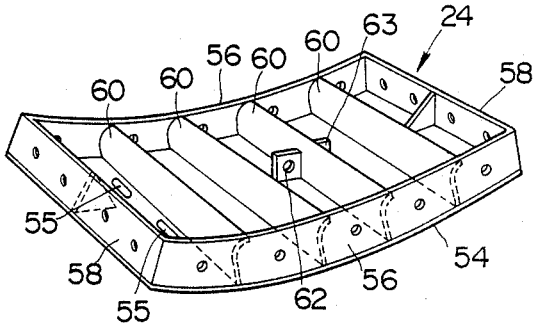
FIG. 5 is an enlarged perspective view of the inner forms in FIG. 1.

The inner forms 24 may be each designed to be movable relative to the associated outer form 26 in an axial direction of the tubular unit 30, in which case guide slots 55 are formed through the body plate 54 of the inner form 24 in the axial direction as illustrated in FIG. 5 and retaining bolts 34 passes through guide slots 55 so that the bolts are slidable in the axial direction.

Figure 13:
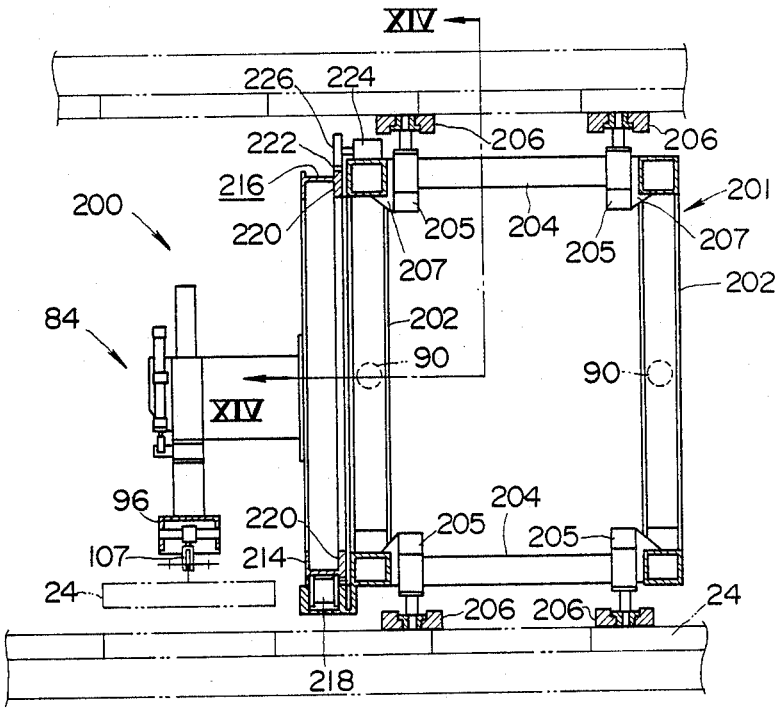
FIG. 13 is a vertical cross-section of a modified form of the assembling device in FIG. 1.
Figure 14:
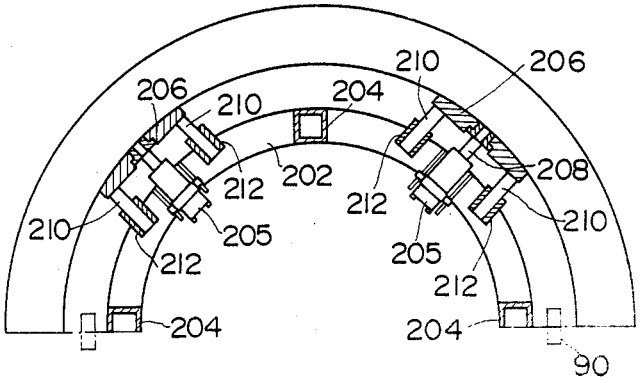
FIG. 14 is a view taken along the line XIV—XIV in FIG. 13.

FIGS. 13 and 14 illustrate a modified form of the disassembling device 76 in FIG. 1. This modified disassembling device 200 is provided with a supporting frame 201 having a pair of ring-shaped frame members 202 and 202 and four horizontal frame members 204 jointed at their opposite ends to respective ring-shaped frame members 202 and 202 in an angularly equi-spaced manner. Each of the ring-shaped frame member 202 has four jacks 205 each mounted through a bracket 207 to it in an angularly spaced manner. Thus, the supporting frame 201 has provided with eight jacks 205 although only four of them are illustrated in FIG. 13. Each jack 205 has an abutting member 206 mounted at its rod 208 for holding the abutting member 206 against inner faces of inner forms 24 of the hollow cylindrical unit 30. The abutting members 206 have each a pair o guide pins 210 and 210 fixed to it and the guide pins 210 and 210 are slidably inserted into guide pipes 212 mounted on corresponding ring-shaped frame members 202. The supporting frame 201 is secured to the inner forms 24 by projecting the rods 208 of the jacks 205. The disassembling device 200 further includes a ring-shaped rotation member 214 instead of the inner gear member 82, the rotation member 214 having substantially a channel cross section. The outer circumferential face of the rotation member 214 has an annular groove 216, into which four rollers 218 are rotatably fitted, the rollers 218 being rotatably supported on the front ring-shaped supporting member 202 in an angularly equi-spaced manner although only one of them are illustrated in FIG. 13. Thus, the rotation member 214 may be rotated on the rollers 218 about its axis. The front ring-shaped supporting member 202 is provided with a drive unit 224 mounted on the front ring-shaped frame member and including an electric motor (not shown), which has a pinion 226 mounted on its output shaft. The pinion 226 meshes with an outer teeth 222 formed in the outer periphery of the inner flange 220 of the rotation member 214 for rotating the latter.

With such a construction, the holding of the disassembling device 200 to the inner forms 24 becomes more stable than that of the disassembling device 76. The assembling device 74 may having the same structure as the disassembling device 200.

While the invention has been disclosed in specific detail for purposes of clarity and complete disclosure, the appended claims are intended to include within their meaning all modifications and changes that come within the true scope of the invention.

What is claimed is:

1. A shield tunneling method for constructing a tunnel, comprising the steps of (a) actuating a shield having shield jacks for drilling a hole in the ground;

(b) assembling inner forms and outer forms into a plurality of jointed tubular units in the hole in a concentrically aligned manner so that an annular concrete lining space is defined between the inner forms and the outer forms, the tubular units having a leading tubular unit;

(c) applying the shield jacks against inner forms of the leading tubular units for thrusting the shield during actuating to the shield to further drill the hole;

(d) injecting a concrete into the annular concrete lining space to form a concrete lining;

(e) setting the concrete lining within a predetermined length of tubular units for providing adhesion to the inner forms, in contact with the concrete lining, against a reaction force of the jack thrust for the shield;

(f) disassembling inner forms of the tubular units, located behind the predetermined length of the tublar units, from the associated outer forms so that the predetermined length of the concrete lining is remained covered with inner forms;

(g) reusing the inner forms, disassembled in the disassembling step (f), in the assembling step (b) for assembling a new tubular unit in the hole just behind the shield.

2. A method as recited in claim 1, wherein the inner forms have an arcuate profile; the outer forms have another arcuate profile; and the assembling step (b) comprises the steps of:

(h) detachably assembling plural pairs of the inner forms and the outer forms into arcuate form assemblies having arcuate profiles for each defining an arcuate concrete lining space between the associated inner form and outer form; and (i) concentrically jointing the arcuate form assemblies to build each of the tubular units.

3. A method as recited in claim 2, wherein in the step (h), the inner form of each arcuate form assembly is attached to the associated outer form so that the inner form is movable relative to the outer form in an axial direction of the tubular unit to be built with the arcuate form assemblies.

4. A method as recited in claim 2, wherein the step (i) further comprises (j) coaxially jointing a plurality of tubular units end to end to form jointed tubular units with annular concrete lining spaces, the jointed tubular units including a leading end, and (k) mounting a pair of end rings to corresponding leading and trailing ends of each of coaxially jointed tubular units for sealing the concrete lining space at the ends.

5. Apparatus for assembling and disassembling a plurality of joined tubular units each having inner forms and outer forms which are to be used in constructing a tunnel in a hole drilled in the ground using a shield, such that the inner and outer forms are assembled to define an annular concrete lining space and after which the inner forms are disassemblable and reuseable, said apparatus comprising:

(a) guiding means mounted to the inner forms of the tubular units;

(b) an assembling erector for assembling the inner forms and outer forms, circumferentially in the hole, into a tubular unit just behind the shield, the assembling erector including, first supporting means, first holding means for releasably holding the first supporting means to the inner forms of the tubular units, first moving means, mounted to the first supporting means, for moving the first supporting means with the guiding means, and transporting means, supported on the first supporting means, for transporting each of the inner forms and the outer forms to a position on a wall of the hole; and (c) a disassembling erector for disassembling the inner forms of the tubular units, located behind a predetermined length of the tubular units, the disassembling erector including, second supporting means, second holding means for releasably holding the second supporting means to the inner forms of the tubular units, second moving means, mounted to the second supporting means, for moving the second supporting means with the guiding means, and separating means, supported on the second supporting means, for separating inner forms of the tubular units, located behind the predetermined length of the tubular units, from the associated outer forms.

6. An apparatus as recited in claim 3 wherein said first holding means comprises a plurality of first jacks, mounted to the first supporting means, for releasably holding the first supporting means to inner forms of the tubular units, and wherein said second holding means comprises a plurality of second jacks, mounted to the second supporting means, for releasably holding the second supporting means to inner forms of the tubular units.

7. An apparatus as recited in claim 6, wherein the assembling erector comprises first rotation means, mounted on the first supporting means, for rotating the transporting means about an axis of the tubular unit to which the first supporting means is held, and wherein the disassembling erector comprises second rotation means, mounted on the second supporting means, for rotating the separating means about an axis of the tubular unit to which the second supporting means is held.

8. An apparatus as recited in claim 7 further comprising second transporting means for transporting the inner forms separated from the tubular units to the first transporting means of the assembling erector.

9. The apparatus as recited in claim 7 wherein the first jacks are mounted to the first supporting means for symmetrical arrangement about an axis of assembled tubular units, having a leading tubular unit and a trailing tubular unit, and for radially extending so that the first supporting means is releasably held to the leading tubular unit, and the second jacks are mounted to the second supporting means for symmetrical arrangement about the axis of the assembled tubular units and for radially extending so that the second supporting means is releasably held to the trailing tubular unit.

10. The apparatus is recited in claim 9 wherein the first supporting means comprises a first supporting ring having the first rotating means mounted thereon, a second supporting ring substantially equal in diameter to the first supporting ring, and plurality of first horizontally supporting frame members, each of the first and second supporting rings having first jacks mounted thereto, the second supporting means including a third supporting ring having the second rotating means mounted thereon, a fourth supporting ring substantially equal in diameter to the third supporting ring, and a plurality of second horizontally supporting frame members, each of the third and fourth supporting rings having second jacks mounted thereto.

* * * * *